United States Patent [19]

Simon

[11] 4,059,335

[45] Nov. 22, 1977

[54] ELECTRIC CONNECTOR

[76] Inventor: Hans Simon, Bruchhausener Strasse, 5463 Unkel (Rhine), Germany

[21] Appl. No.: 661,274

[22] Filed: Feb. 25, 1976

[30] Foreign Application Priority Data

Mar. 3, 1975 Germany ..... 2509158

[51] Int. Cl.[2] ..... H01R 7/08

[52] U.S. Cl. ..... 339/272 UC; 403/362

[58] Field of Search ..... 339/272; 24/115 P, 135 N; 403/362

[56] References Cited

U.S. PATENT DOCUMENTS

| | | | |
|---|---|---|---|
| 2,205,322 | 6/1940 | Thomas, Sr. et al. | 339/272 UC |
| 3,864,005 | 2/1975 | Klein | 339/272 R |

FOREIGN PATENT DOCUMENTS

| | | | |
|---|---|---|---|
| 713,146 | 11/1941 | Germany | 339/272 UC |
| 936,403 | 12/1955 | Germany | 339/272 R |

*Primary Examiner*—Joseph H. McGlynn
*Attorney, Agent, or Firm*—Steinberg & Blake

[57] ABSTRACT

Electric connector comprising a U-shaped main portion the parallel legs of which are respectively formed with two intermediate cutout portions facing each other, a preferably square nut penetrating through these cutout portions, and a terminal screw inserted therein the head of which has a diameter greater than the distance between the two legs and at the end of each leg, distant from the transverse base of the main portion above each of the intermediate cutout portions, an additional cutout being provided for receiving the head of the terminal screw, and between the legs a leaf spring being arranged, wherein the height of each of the intermediate cutout portions provided for the nut is greater than the thickness of the nut and of the spring, the leaf spring being convexly curved in the longitudinal direction, including a central hole and being arranged between said nut and edges of the intermediate cutout portions distant from the base.

7 Claims, 5 Drawing Figures

ELECTRIC CONNECTOR

The invention relates to an electric connector comprising a U-shaped main portion the parallel legs of which contain two cutouts facing each other, a preferably square nut penetrating through the clearances, and a terminal screw inserted therein the head of which shows either a flat or lightly curved surface, the distance between the inner sides of the two legs being smaller than the head diameter of the terminal screw, and at the end of each leg, averted from the base side of the main portion, an opening being provided for the head of the terminal screw, and between the legs a leaf spring convexly curved in the longitudinal direction and having a broadness corresponding to the distance of the inner sides of the legs being arranged. Such a connector has been known from German Pat. No. 2,232,556.

As has been shown in this patent, it is the purpose of the convexly curved leaf spring arranged between the legs to eliminate the well known disadvantages of the cold flow of the clamped copper or litzen wire and to avoid the decrease of the contact pressure which is experienced after each switching on and off of the current flowing through the connector caused by thermal expansion and subsequent cooling off. If this decrease of the contact pressure is not avoided, a decrease of the conductive cross section will occur, as the clamped conductor is no longer in overall contact with the clamp but only in certain points, at the edges, at the terminal screw, or at the wire protection which acts like a cross section decrease as an increased contact resistance and can heat up that much that glow occurs and there may be the danger of fire. This danger which has generally been known in rigid connector structures (for instance porcelain insulators) cannot only lead, in certain cases, to inoperation or destruction of the connector but also to fires.

The arrangement of the leaf spring at the bottom of the U-shaped base portion as has been known through above referenced German Pat. No. 2,232,556, has the disadvantage that it is in the current path and, if arched, presses the conductor against the terminal screw. By this, the optimum of the conductive cross section is not kept but rather reduced. The leaf spring is moreover directly heated which can have an adverse effect on the life time.

The arrangement of the leaf spring at the bottom of the U-shaped main portion of the connector renders it necessary that for the mounting of the leaf spring a tool is necessary with the aid of which the leaf spring can be pressed over the four projections at the leg edges of the main portion which leads to relatively unfavorable mounting times. The punching tool for the connector is moreover subject to an increased wear in the area of the projections. In addition, it has shown that by arranging the leaf spring within the current path where it is immediately subjected to the heat caused by the current, the spring characteristics are unfavorably affected in the long run.

These disadvantages are to be overcome by the present invention. It is therefore the aim of the invention to provide for measures which simplify the mounting of the leaf spring, make it less expensive, and guarantee that the spring characteristics do not, or only to a reduced extent, change during the life of the connector.

This aim is solved, in accordance with the invention, in that the height of each of the cutouts provided for the nut is greater than the thickness of the nut and of a spring convexly bent in the longitudinal direction which includes a central hole and is arranged between said nut and the edges of the cutouts neighboring the nut, and is provided with means to secure the position thereof.

In such a structure, the contact pressure is obtained through the leaf spring portion acting via the terminal screw onto the conductor. The leaf spring portion is now no longer in the current path so that any influence on the spring characteristics by the current heat is excluded. The leaf spring portion is moreover in an area which is accessible during the mounting process so that the leaf spring portion can be mounted fully automatically. Projections, or notches, respectively, in the main portion of the connector in order to fix the leaf spring portion are no longer needed. It is a particularly advantageous feature of the connector structure according to the invention that, if the leaf spring portion is correspondingly shaped, special means for avoiding deflection of the two legs of the U-shaped main portion in the area of the nut, if the terminal screw is forcedly tightened, can be dispensed with, which means that the sheet strip passing through the cutouts and arranged in parallel to one of the edges of the nut and having, at its longitudinal edges, two pairs of cams arranged at a distance corresponding to the distance of the outer sides of the legs of the above referenced patent specification is no longer needed. The whole assembly of the connector is thereby considerably simplified and the production costs are essentially reduced.

As a means for the fixation of the position of the leaf spring portion, there is preferably provided, at the edges of the spring leaf adjacent to the two legs of the main portion, an extension each projecting into the space formed by the two legs. It is however considerably more advantageous to provide a modification wherein two tongues each are provided at the edges of the leaf spring portion facing the legs of the main portion, the inner side of which rests against the outer sides of the legs. By so shaping the leaf spring portion it is safeguarded at the same time that if the terminal screw is tightened with an increased force, the two legs of the U-shaped main portion cannot, in the area of the nut, deflect to the outside.

In order to additionally fix the position of the nut, it has proved to be useful to provide the leaf spring portion, at its edges parallel to the legs of the main portion, with an angular lug each resting against one of the edges of the nut.

In accordance with a further feature of the invention, the leaf spring portions consist of a bi-metal. Particularly in case of a loosened contact connection when because of the increased contact resistances increased heating of the connector will be experienced, an increase of the contact pressure between the connector and the conductor, and thus a decrease of the contact resistance between them, that is a restriction of the heating, is obtained by the temperature-caused deflection of the bi-metallic leaf spring portion.

The invention will now be explained in more detail in connection with the Drawing which illustrates, partly in a diagrammatic representation, an embodiment of the invention.

Figure 1:
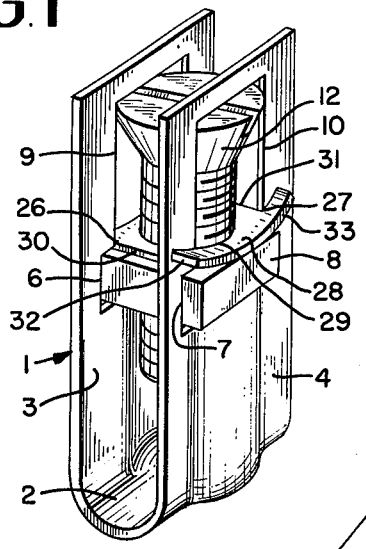
FIG. 1 is a perspective view of a connector in accordance with the invention.
Figure 2:
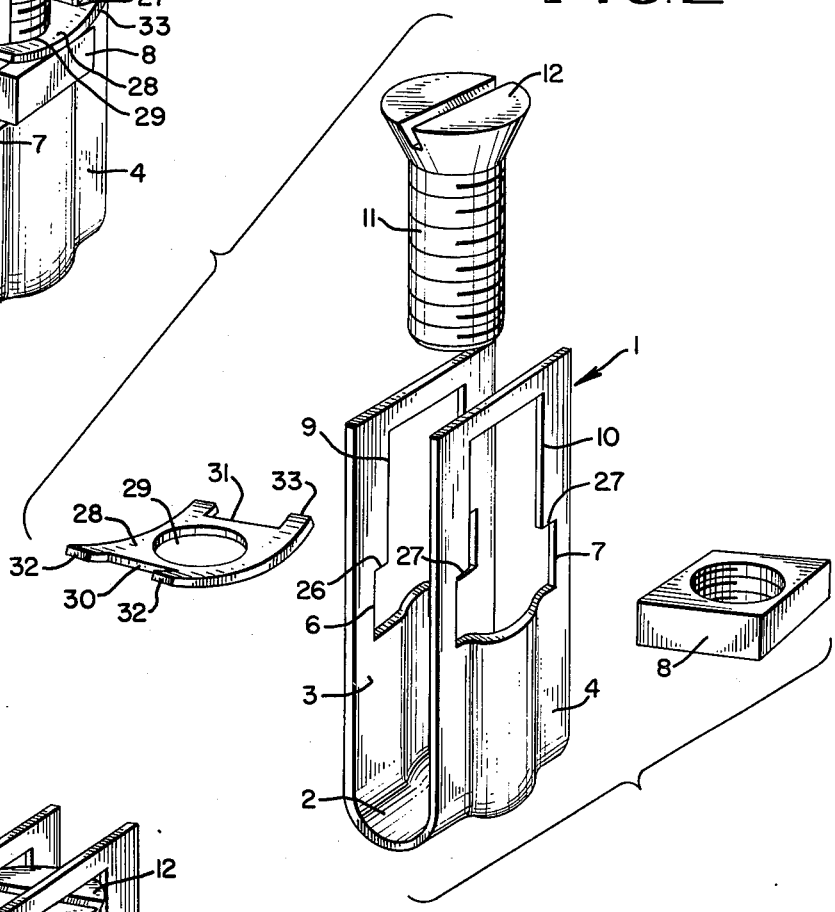
FIG. 2 is an exploded perspective view of a connector in accordance with FIG. 1.

As can be taken from FIGS. 1 and 2, the electric connector comprises a U-shaped main portion 1 including a transverse base 2 and two legs 3 and 4 parallel to each other. In the two legs 3 and 4, there are formed intermediate cutout portions 6 and 7, respectively, into which a square nut 8 can be inserted. The height of cutout portions 6 and 7 is greater than the thickness of square nut 8. Cutout portions 6 and 7 are each continued or extended, at edges formed by shoulders 26 and 27 distant from base 2, into two additional cutout portions 9 and 10 which have an elongated rectangular shape and are narrower than the length of cutout portions 6 and 7. Into nut 8, terminal screw 11 having a slotted flat head 12 can be screwed. Between nut 8 and shoulders 26 and 27, respectively, formed by cutout portions 6 and 9 and 7 and 10, respectively, there is arranged a curved leaf spring 28 having a central hole 29.

At the edges 30 and 31 of spring 28 facing the two legs 3 and 4 of main portion 1, there are provided two tongues 32 and 33, respectively, each. The inner sides of tongues 32 and 33 rest against the outer sides of legs 3 and 4, respectively.

When assembling connector 1, leaf spring 28 is inserted, at an inclination relative to the upper edges of the legs, into the cutout portions 6 and 7 and subsequently nut 8 is moved into the space between the side of leaf spring 28 facing base 2 and the edges of cutout portions 6 and 7 neighboring base 2. Screw 11 is then screwed into nut 8. Because of the conic lower side of screw head 12, legs 3 and 4 will spread and snap back into the original position when the upper side of screw head 12 reaches the upper edge of the additional cutouts 9 and 10. In this way, all portions of the connector are in a close connection with each other.

Figure 3:
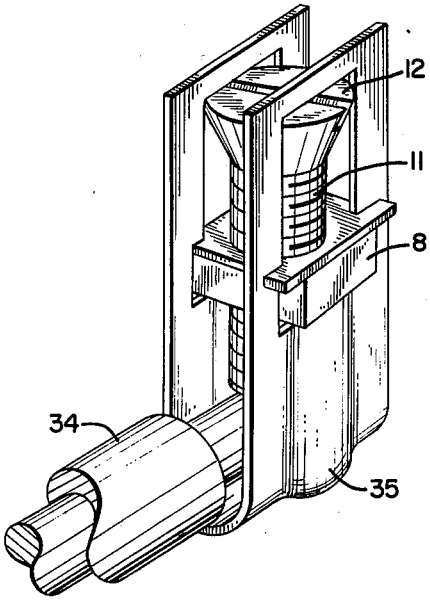
FIG. 3 is a perspective view of a connector in accordance with FIG. 1 including a conductor secured therein.

If a conductor 34 is clamped within the connector, nut 8 will move, as can be seen from FIG. 3, at each revolution of screw 11, further to the top whereby the force exerted by leaf spring 28 on nut 8 is increased. Nut 8 is therefore, if conductor 34 is clamped within the connector, under a constant force exerted by spring 28, which prevents the clamped connection from loosening by vibrations on one side and guarantees that even after a plurality of heating and cooling cycles no decrease of the contact pressure is experienced. In order to improve the natural stability of the connector, legs 3 and 4 are each provided with a crimp 35.

Figure 4:
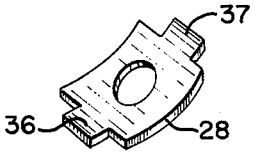
FIG. 4 shows a special embodiment of the leaf spring portion.

FIG. 4 displays a different form of a leaf spring 28 showing at the edges 30, 31 adjacent to the two legs 3, 4 of main portion 1 extensions 36 and 37, respectively, projecting into the space between the legs 3, 4.

Figure 5:
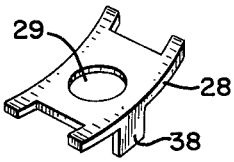
FIG. 5 shows a leaf spring having an angular lug resting against one edge of the nut.

For the fixation of the position of nut 8 in intermediate cutout portions 6 and 7 of the two legs 3 and 4, respectively, there is provided, in FIG. 5, at each of the edges of leaf spring 28 parallel to the legs of main portion 1 an angular lug 38 resting against one edge of nut 8.

I claim:

1. Electric connector comprising a U-shaped main portion having parallel legs and a transverse base extending therebetween, said legs respectively being formed with aligned intermediate cutout portions, a nut extending between said legs and into said intermediate cutout portions thereof, and a screw threaded through said nut and situated between said legs while having a head situated at a greater distance from said base than said nut and an opposed free end situated nearer to said base than said nut and adapted to engage a conductor extending along said base between said legs, each of said intermediate cutout portions being defined in part by opposed transverse edge portions of each leg which extend transversely with respect to the axis of said screw and which are situated from each other by a distance substantially greater than the thickness of said nut, and a leaf spring extending together with said nut between said legs and into said intermediate cutout portions thereof, said leaf spring being formed with a substantially central hole through which said screw extends and engaging said nut at the region of said hole while being curved away from said nut toward one of said transverse edge portions of each intermediate cutout portion when said nut is in the region of the other of said transverse edge portions of each intermediate cutout portion, so that when said screw is turned at said free end thereof with respect to said nut into engagement with a conductor said nut will move along said screw away from said other toward said one transverse edge portion of each intermediate cutout portion to compress said leaf spring between said one transverse edge portion of each intermediate cutout portion and said nut for limiting pressure of the screw with respect to the conductor while preventing loosening of the screw by vibrations, said leaf spring extending outwardly beyond said legs and having outside of the space between said legs integral tongues projecting beyond said intermediate cutout portions so that said legs are situated between said tongues to be reinforced thereby for preventing outward buckling of said legs.

2. The combination of claim 1 and wherein said leaf spring has opposed free edges extending respectively along opposed side surfaces of said nut and said leaf spring having at said opposed free edges thereof a pair of lugs respectively overlapping said side surfaces of said nut.

3. The combination of claim 1 and wherein said leaf spring is made of a bi-metallic material.

4. The combination of claim 1 and wherein said legs are formed more distant from said base than said intermediate cutout portions thereof with additional cutout portions, respectively, and said screw head having a diameter greater than the distance between said legs and being received in said additional cutout portions of said legs.

5. The combination of claim 4 and wherein said additional cutout portions respectively form extensions of said intermediate cutout portions and are narrower than said intermediate cutout portions, the latter having shoulders at their junctions with said additional cutout portions and said shoulders being defined by said one transverse edge portions of said intermediate cutout portions which engage said leaf spring when said nut is advanced toward said one transverse edge portions during turning of said screw while said free end thereof engages a conductor.

6. The combination of claim 1 and wherein said leaf spring has a convex surface engaging said nut.

7. The combination of claim 6 and wherein said leaf spring is situated between said nut and said head of said screw.

* * * * *